US008738169B2

(12) United States Patent
Muto et al.

(10) Patent No.: US 8,738,169 B2
(45) Date of Patent: May 27, 2014

(54) COMPUTER CONTROLED SEWING MACHINE WITH CUTTING NEEDLES

(71) Applicants: Yukiyoshi Muto, Nagoya (JP); Tomotaka Katano, Nagoya (JP)

(72) Inventors: Yukiyoshi Muto, Nagoya (JP); Tomotaka Katano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/664,961

(22) Filed: Oct. 31, 2012

(65) Prior Publication Data

US 2013/0112129 A1 May 9, 2013

(30) Foreign Application Priority Data

Nov. 9, 2011 (JP) ..... 2011-245188

(51) Int. Cl.
*D05C 5/02* (2006.01)

(52) U.S. Cl.
USPC ..... 700/137

(58) Field of Classification Search
USPC ..... 700/136–138
See application file for complete search history.

(56) References Cited

U.S. PATENT DOCUMENTS

| | | | | |
|---|---|---|---|---|
| 1,120,357 A | | 12/1914 | Austin | |
| 3,765,350 A | * | 10/1973 | Sztari | 112/122 |
| 4,247,998 A | | 2/1981 | Foss | |
| 4,411,208 A | | 10/1983 | Nishida et al. | |
| 4,422,250 A | | 12/1983 | Golan | |
| 4,598,655 A | | 7/1986 | Takenoya | |
| 4,774,778 A | | 10/1988 | Williams | |
| 5,144,899 A | * | 9/1992 | Allen | 112/103 |
| 5,222,314 A | | 6/1993 | Inteso | |
| 5,361,713 A | * | 11/1994 | Suzuki | 112/68 |
| 5,555,834 A | * | 9/1996 | Bonner | 112/129 |
| 5,970,895 A | | 10/1999 | Mack | |
| 6,006,685 A | * | 12/1999 | Kastrup et al. | 112/68 |
| 7,280,886 B2 | * | 10/2007 | Iida et al. | 700/138 |
| 7,302,308 B2 | * | 11/2007 | Kato et al. | 700/138 |
| 7,966,955 B2 | * | 6/2011 | Niizeki | 112/89 |
| 2010/0050915 A1 | | 3/2010 | Konig et al. | |

FOREIGN PATENT DOCUMENTS

| | | |
|---|---|---|
| JP | A-59-181185 | 10/1984 |
| JP | A-3-193090 | 8/1991 |
| JP | A-5-123464 | 5/1993 |
| JP | U-6-4094 | 1/1994 |

(Continued)

OTHER PUBLICATIONS

Sep. 30, 2013 Office Action issued in U.S. Appl. No. 13/665,242.

(Continued)

*Primary Examiner* — Danny Worrell
(74) *Attorney, Agent, or Firm* — Oliff PLC

(57) ABSTRACT

An apparatus includes a processor and a memory. The memory is configured to store computer-readable instructions that instruct the apparatus to execute steps including acquiring pattern data, identifying a plurality of needle drop points, identifying a corresponding identified needle, storing needle drop point data and identified needle data in association with each other in the memory, identifying a continuous number of times, replacing, among the identified needle data stored in the memory, the identified needle data of the identified needle for which the identified continuous number of times is smaller than a threshold value, with other identified needle data corresponding to the needle drop point data of one of a previous needle drop point and a subsequent needle drop point in the order, and generating cut data based on the needle drop point data and the identified needle data stored in the memory.

12 Claims, 14 Drawing Sheets

(56) References Cited

FOREIGN PATENT DOCUMENTS

| | | |
|---|---|---|
| JP | A-9-217261 | 8/1997 |
| JP | A-2002-136784 | 5/2002 |
| WO | WO 98/24962 A1 | 6/1998 |

OTHER PUBLICATIONS

U.S. Appl. No. 13/758,205, filed Feb. 4, 2013.
U.S. Appl. No. 13/665,242, filed Oct. 31, 2012.

* cited by examiner

FIG. 10

141

| NEEDLE DROP POINTS | Q0 | Q1 | Q2 | Q3 | Q4 | Q5 | Q6 | Q7 | Q8 | Q9 | Q10 | Q11 | Q12 | Q13 | Q14 | Q15 | Q16 | Q17 | Q18 | Q19 | Q20 | Q21 | Q22 |
|---|---|---|---|---|---|---|---|---|---|---|---|---|---|---|---|---|---|---|---|---|---|---|---|
| IDENTIFIED NEEDLE | 2, 4 | 4 | 4 | 4 | 4, 1 | 1 | 1 | 1, 2 | 2 | 2 | 2 | 2, 3 | 3, 4 | 4 | 4 | 4 | 4 | 4 | 4 | 4, 1 | 1 | 1 | 1 |

| | Q23 | Q24 | Q25 | Q26 | Q27 | Q28 | Q29 | Q30 | Q31 | Q32 | Q33 | Q34 | Q35 | Q36 | Q37 | Q38 | Q39 | Q40 | Q41 | Q42 | Q43 | Q44 | Q45 |
|---|---|---|---|---|---|---|---|---|---|---|---|---|---|---|---|---|---|---|---|---|---|---|---|
| | 1, 2 | 2 | 2 | 2 | 2, 3 | 3 | 3 | 3, 1 | 1 | 1 | 1 | 1 | 1 | 1 | 1, 2 | 2 | 2, 3 | 3 | 3 | 3, 4 | 4 | 4 | 4 |

| | Q46 | Q47 | Q48 | Q49 | Q50 | Q51 | Q52 | Q53 | Q54 | Q55 | Q56 | Q57 | Q58 | Q59 | Q60 | Q61 | Q62 | Q63 | Q64 | Q65 | Q66 | Q67 | Q68 |
|---|---|---|---|---|---|---|---|---|---|---|---|---|---|---|---|---|---|---|---|---|---|---|---|
| | 4 | 4, 1 | 1, 2 | 2 | 2 | 2 | 2, 3 | 3 | 3 | 3 | 3 | 3, 4 | 4 | 4 | 4 | 4 | 4 | 4, 1 | 1 | 1 | 1 | 1, 2 | 2 |

| | Q69 | Q70 | . . . . . |
|---|---|---|---|
| | 2 | 2 | . . . . . |

FIG. 11

141

| NEEDLE DROP POINTS | Q0 | Q1 | Q2 | Q3 | Q4 | Q5 | Q6 | Q7 | Q8 | Q9 | Q10 | Q11 | Q12 | Q13 | Q14 | Q15 | Q16 | Q17 | Q18 | Q19 | Q20 | Q21 | Q22 |
|---|---|---|---|---|---|---|---|---|---|---|---|---|---|---|---|---|---|---|---|---|---|---|---|
| IDENTIFIED NEEDLE | 2, 4 | 4 | 4 | 4 | 4, 1 | 1 | 1 | 1, 2 | 2 | 2 | 2 | 2, 4 | 4 | 4 | 4 | 4 | 4 | 4 | 4 | 4, 1 | 1 | 1 | 1 |

| Q23 | Q24 | Q25 | Q26 | Q27 | Q28 | Q29 | Q30 | Q31 | Q32 | Q33 | Q34 | Q35 | Q36 | Q37 | Q38 | Q39 | Q40 | Q41 | Q42 | Q43 | Q44 | Q45 |
|---|---|---|---|---|---|---|---|---|---|---|---|---|---|---|---|---|---|---|---|---|---|---|
| 1, 2 | 2 | 2 | 2 | 2, 3 | 3 | 3 | 3, 1 | 1 | 1 | 1 | 1 | 1 | 1 | 1, 3 | 3 | 3 | 3 | 3 | 3, 4 | 4 | 4 | 4 |

| Q46 | Q47 | Q48 | Q49 | Q50 | Q51 | Q52 | Q53 | Q54 | Q55 | Q56 | Q57 | Q58 | Q59 | Q60 | Q61 | Q62 | Q63 | Q64 | Q65 | Q66 | Q67 | Q68 |
|---|---|---|---|---|---|---|---|---|---|---|---|---|---|---|---|---|---|---|---|---|---|---|
| 4 | 4, 2 | 2 | 2 | 2 | 2 | 2, 3 | 3 | 3 | 3 | 3 | 3, 4 | 4 | 4 | 4 | 4 | 4 | 4, 1 | 1 | 1 | 1 | 1, 2 | 2 |

| Q69 | Q70 | . | . | . | . | . |
|---|---|---|---|---|---|---|
| 2 | 2 | . | . | . | . | . |

FIG. 12

141

| NEEDLE DROP POINTS | Q4 | Q5 | Q6 | Q7 | Q19 | Q20 | Q21 | Q22 | Q23 | Q30 | Q31 | Q32 | Q33 | Q34 | Q35 | Q36 | Q37 | Q63 | Q64 | Q65 | Q66 | Q67 |
|---|---|---|---|---|---|---|---|---|---|---|---|---|---|---|---|---|---|---|---|---|---|---|
| IDENTIFIED NEEDLE | 4, 1 | 1 | 1 | 1, 2 | 4, 1 | 1 | 1 | 1 | 1, 2 | 3, 1 | 1 | 1 | 1 | 1 | 1 | 1 | 1, 3 | 4, 1 | 1 | 1 | 1 | 1, 2 |

| Q7 | Q8 | Q9 | Q10 | Q11 | Q23 | Q24 | Q25 | Q26 | Q27 | Q47 | Q48 | Q49 | Q50 | Q51 | Q52 | Q67 | Q68 | Q69 | Q70 · · · |
|---|---|---|---|---|---|---|---|---|---|---|---|---|---|---|---|---|---|---|---|
| 1, 2 | 2 | 2 | 2 | 2, 4 | 1, 2 | 2 | 2 | 2 | 2, 3 | 4, 2 | 2 | 2 | 2 | 2 | 2, 3 | 1, 2 | 2 | 2 | 2 · · · |

| Q27 | Q28 | Q29 | Q30 | Q37 | Q38 | Q39 | Q40 | Q41 | Q42 | Q52 | Q53 | Q54 | Q55 | Q56 | Q57 |
|---|---|---|---|---|---|---|---|---|---|---|---|---|---|---|---|
| 2, 3 | 3 | 3 | 3, 1 | 1, 3 | 3 | 3 | 3 | 3 | 3, 4 | 2, 3 | 3 | 3 | 3 | 3 | 3, 4 |

| Q0 | Q1 | Q2 | Q3 | Q4 | Q11 | Q12 | Q13 | Q14 | Q15 | Q16 | Q17 | Q18 | Q19 | Q42 | Q43 | Q44 | Q45 | Q46 | Q47 | Q57 | Q58 | Q59 | Q60 | Q61 | Q62 | Q63 |
|---|---|---|---|---|---|---|---|---|---|---|---|---|---|---|---|---|---|---|---|---|---|---|---|---|---|---|
| 2, 4 | 4 | 4 | 4 | 4, 1 | 2, 4 | 4 | 4 | 4 | 4 | 4 | 4 | 4 | 4, 1 | 3, 4 | 4 | 4 | 4 | 4 | 4, 2 | 3, 4 | 4 | 4 | 4 | 4 | 4 | 4, 1 |

FIG. 13

141

| NEEDLE DROP POINTS | Q4 | Q5 | Q6 | Q7 | Q19 | Q20 | Q21 | Q22 | Q23 | Q30 | Q31 | Q32 | Q33 | Q34 | Q35 | Q36 | Q37 | Q63 | Q64 | Q65 | Q66 | Q67 |
|---|---|---|---|---|---|---|---|---|---|---|---|---|---|---|---|---|---|---|---|---|---|---|
| IDENTIFIED NEEDLE | 4, 1 | 1 | 1 | 1, 2 | 4, 1 | 1 | 1 | 1 | 1, 2 | 3, 1 | 1 | 1 | 1 | 1 | 1 | 1 | 1, 3 | 4, 1 | 1 | 1 | 1 | 1, 2 |

| Q67 | Q68 | Q69 | Q70 | · · · | Q7 | Q8 | Q9 | Q10 | Q11 | Q23 | Q24 | Q25 | Q26 | Q27 | Q47 | Q48 | Q49 | Q50 | Q51 | Q52 |
|---|---|---|---|---|---|---|---|---|---|---|---|---|---|---|---|---|---|---|---|---|
| 1, 2 | 2 | 2 | 2 | · · · | 1, 2 | 2 | 2 | 2 | 2, 4 | 1, 2 | 2 | 2 | 2 | 2, 3 | 4, 2 | 2 | 2 | 2 | 2 | 2, 3 |

| Q52 | Q53 | Q54 | Q55 | Q56 | Q57 | Q27 | Q28 | Q29 | Q30 | Q37 | Q38 | Q39 | Q40 | Q41 | Q42 |
|---|---|---|---|---|---|---|---|---|---|---|---|---|---|---|---|
| 2, 3 | 3 | 3 | 3 | 3 | 3, 4 | 2, 3 | 3 | 3 | 3, 1 | 1, 3 | 3 | 3 | 3 | 3 | 3, 4 |

| Q42 | Q43 | Q44 | Q45 | Q46 | Q47 | Q57 | Q58 | Q59 | Q60 | Q61 | Q62 | Q63 | Q0 | Q1 | Q2 | Q3 | Q4 | Q11 | Q12 | Q13 | Q14 | Q15 | Q16 | Q17 | Q18 | Q19 |
|---|---|---|---|---|---|---|---|---|---|---|---|---|---|---|---|---|---|---|---|---|---|---|---|---|---|---|
| 3, 4 | 4 | 4 | 4 | 4 | 4, 2 | 3, 4 | 4 | 4 | 4 | 4 | 4 | 4, 1 | 2, 4 | 4 | 4 | 4 | 4, 1 | 2, 4 | 4 | 4 | 4 | 4 | 4 | 4 | 4 | 4 |

COMPUTER CONTROLED SEWING MACHINE WITH CUTTING NEEDLES

CROSS-REFERENCE TO RELATED APPLICATION

This application claims priority to Japanese Patent Application No. 2011-245188, filed Nov. 9, 2011, the content of which is hereby incorporated herein by reference in its entirety.

BACKGROUND

The present disclosure relates to an apparatus that can generate data that may be used in a sewing machine in order to foal) cuts in a work cloth along a line indicating a shape of a specified pattern.

A sewing machine is known in which a cutting needle can be attached to the lower end of a needle bar, instead of a sewing needle. The cutting needle is a rod-like member having a sharp cutting edge on its leading end. The sewing machine may cause the cutting needle to move up and down by moving the needle bar up and down, in the same manner as when performing sewing, and repeatedly insert the cutting needle into a work cloth. The sewing machine may cut warp threads and weft threads of the work cloth using the cutting needle, and thereby form cuts in the work cloth. The sewing machine may cause an embroidery frame that holds the work cloth to move in synchronization with the up-down movement of the needle bar. By doing this, the sewing machine can form cuts in the work cloth along a line indicating a shape of a specified pattern.

A sewing machine is known in which two cutting needles can be attached to the lower ends of needle bars, respectively, in a state in which directions of cutting edges on the leading ends of the cutting needles are orthogonal to each other. One of the cutting needles may be attached to the needle bar in a state in which the direction of its cutting edge is orthogonal to a direction in which warp threads of a work cloth extend. The other cutting needle may be attached to the needle bar in a state in which the direction of its cutting edge is orthogonal to a direction in which weft threads of the work cloth extend. The sewing machine may cut the warp threads, using the one of the cutting needles. Then, the sewing machine may cut the weft threads, using the other cutting needle. By doing this, the sewing machine can form cuts in the work cloth.

SUMMARY

If a sewing machine, in which four cutting needles are attached in a state in which directions of their cutting edges are intersecting with each other, forms cuts in the work cloth while switching the four cutting needles, cuts with an improved appearance can be formed along a line indicating a shape of a pattern, as compared to a case in which the cuts are formed using two cutting needles.

In the above-described sewing machine, it is necessary to more frequently switch the cutting needle to be used. Therefore, more time to switch the cutting needle is required in addition to time to actually form the cuts. For that reason, there is a possibility that a long time is required for the sewing machine to form the cuts in the work cloth along the line indicating the shape of the specified pattern.

Various embodiments of the broad principles derived herein provide an apparatus that can generate cut data to cause a sewing machine to form cuts in a work cloth in a short time along a line showing a shape of a specified pattern, a non-transitory computer-readable medium storing computer readable-instructions that cause the apparatus to generate the cut data, and a sewing machine that can generate the cut data and form the cuts in the work cloth.

Various embodiments provide an apparatus that includes a processor and a memory. The memory is configured to store computer-readable instructions. The computer-readable instructions instruct the apparatus to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying, as a corresponding identified needle, one of a plurality of cutting needles configured to be attachable to a plurality of needle bars of a multi-needle sewing machine in a state in which directions of cutting edges of the plurality of cutting needles are different from each other, the identifying being performed for each of the plurality of needle drop points, storing needle drop point data and identified needle data in association with each other in the memory, the needle drop point data being data indicating each of the plurality of needle drop points, and the identified needle data being data indicating the identified needle identified for each of the plurality of needle drop points, identifying, based on the needle drop point data and the identified needle data stored in the memory, a continuous number of times, which is the number of times that the identified needle is continuously the same in an adjacent order on the pattern line, replacing, among the identified needle data stored in the memory, the identified needle data of the identified needle for which the identified continuous number of times is smaller than a threshold value, with other identified needle data corresponding to the needle drop point data of one of a previous needle drop point and a subsequent needle drop point in the order, and generating cut data based on the needle drop point data and the identified needle data stored in the memory, the cut data being data for the multi-needle sewing machine to sequentially insert the corresponding identified needle at the plurality of needle drop points along the pattern line.

Embodiments also provide a non-transitory computer-readable medium storing computer-readable instructions. The computer-readable instructions instruct an apparatus to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying, as a corresponding identified needle, one of a plurality of cutting needles configured to be attachable to a plurality of needle bars of a multi-needle sewing machine in a state in which directions of cutting edges of the plurality of cutting needles are different from each other, the identifying being performed for each of the plurality of needle drop points, storing needle drop point data and identified needle data in association with each other in a memory, the needle drop point data being data indicating each of the plurality of needle drop points, and the identified needle data being data indicating the identified needle identified for each of the plurality of needle drop points, identifying, based on the needle drop point data and the identified needle data stored in the memory, a continuous number of times, which is the number of times that the identified needle is continuously the same in an adjacent order on the pattern line, replacing, among the identified needle data stored in the memory, the identified needle data of the identified needle for which the identified continuous number of times is smaller than a threshold value, with other identified needle data corresponding to the needle drop point data of one of a previous needle drop point and a subsequent needle drop point in the order, and generating cut data based on the needle drop point data and the identified needle data stored in the memory, the cut data being data for the multi-needle sewing machine to sequentially insert the corresponding identified needle at the plurality of needle drop points along the pattern line.

Embodiments further provide a sewing machine that includes a plurality of needle bars, a processor, and a memory. A plurality of cutting needles are configured to be attachable to the plurality of needle bars in a state in which directions of cutting edges of the plurality of cutting needles are different from each other. The memory is configured to store computer-readable instructions. The computer-readable instructions instruct the sewing machine to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying one of the plurality of cutting needles as a corresponding identified needle, the identifying being performed for each of the plurality of needle drop points, storing needle drop point data and identified needle data in association with each other in the memory, the needle drop point data being data indicating each of the plurality of needle drop points, and the identified needle data being data indicating the identified needle identified for each of the plurality of needle drop points, identifying, based on the needle drop point data and the identified needle data stored in the memory, a continuous number of times, which is the number of times that the identified needle is continuously the same in an adjacent order on the pattern line, replacing, among the identified needle data stored in the memory, the identified needle data of the identified needle for which the identified continuous number of times is smaller than a threshold value, with other identified needle data corresponding to the needle drop point data of one of a previous needle drop point and a subsequent needle drop point in the order, generating cut data based on the needle drop point data and the identified needle data stored in the memory, the cut data being data for the sewing machine to sequentially insert the corresponding identified needle at the plurality of needle drop points along the pattern line, and generating a signal based on the cut data, the sewing machine being configured to form the cuts in the work cloth based on the signal.

BRIEF DESCRIPTION OF THE DRAWINGS

Embodiments will be described below in detail with reference to the accompanying drawings in which:

FIG. 10 is an explanatory diagram of a table;

FIG. 11 is an explanatory diagram of the table after part of identified needle data is corrected;

FIG. 12 is an explanatory diagram of the table after data is re-arranged;

FIG. 13 is an explanatory diagram of the table after the data is further re-arranged.

DETAILED DESCRIPTION

Hereinafter, an embodiment will be explained with reference to the drawings. A configuration of a multi-needle sewing machine (hereinafter simply referred to as a sewing machine) 1 according to the embodiment will be explained with reference to FIG. 1 to FIG. 3. The upper side, the lower side, the lower left side, the upper right side, the upper left side and the lower right side of FIG. 1 respectively correspond to the upper side, the lower side, the front side, the rear side, the left side and the right side of the sewing machine 1.

Figure 1:
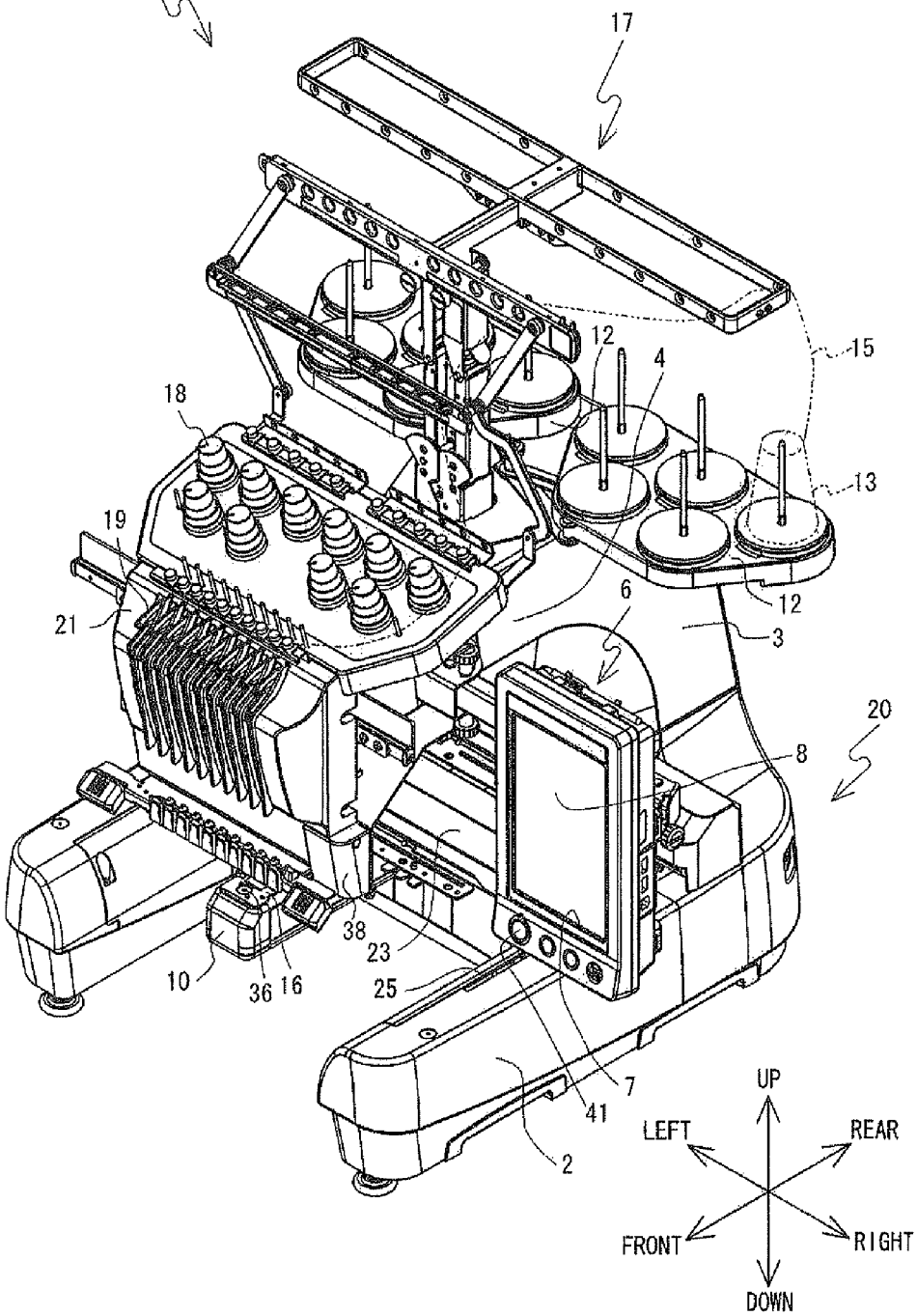
FIG. 1 is a perspective view of a sewing machine.

As shown in FIG. 1, a main body 20 of the sewing machine 1 includes a support portion 2, a pillar 3 and an arm portion 4. The support portion 2 is a base portion that is formed in an inverted U-shape in a plan view. A pair of left and right guide grooves 25, which extend in a front-rear direction, are provided in an upper surface of the support portion 2. The pillar 3 extends upward from a rear end portion of the support portion 2. The arm portion 4 extends to the front from an upper end portion of the pillar 3. A needle bar case 21 is attached to the front end of the arm portion 4 such that the needle bar ease 21 can move in a left-right direction. Ten needle bars 31 (refer to FIG. 2), which extend in an up-down direction, are disposed inside the needle bar case 21 at an equal interval in the left-right direction. One of the ten needle bars 31 that is in a sewing position may be caused to slide in the up-down direction by a needle bar drive mechanism 32 (refer to FIG. 4) that is provided inside the needle bar case 21. One of a sewing needle 51 and a cutting needle 52 (refer to FIG. 2) can be detachably attached to the lower end of each of the needle bars 31.

Figure 2:
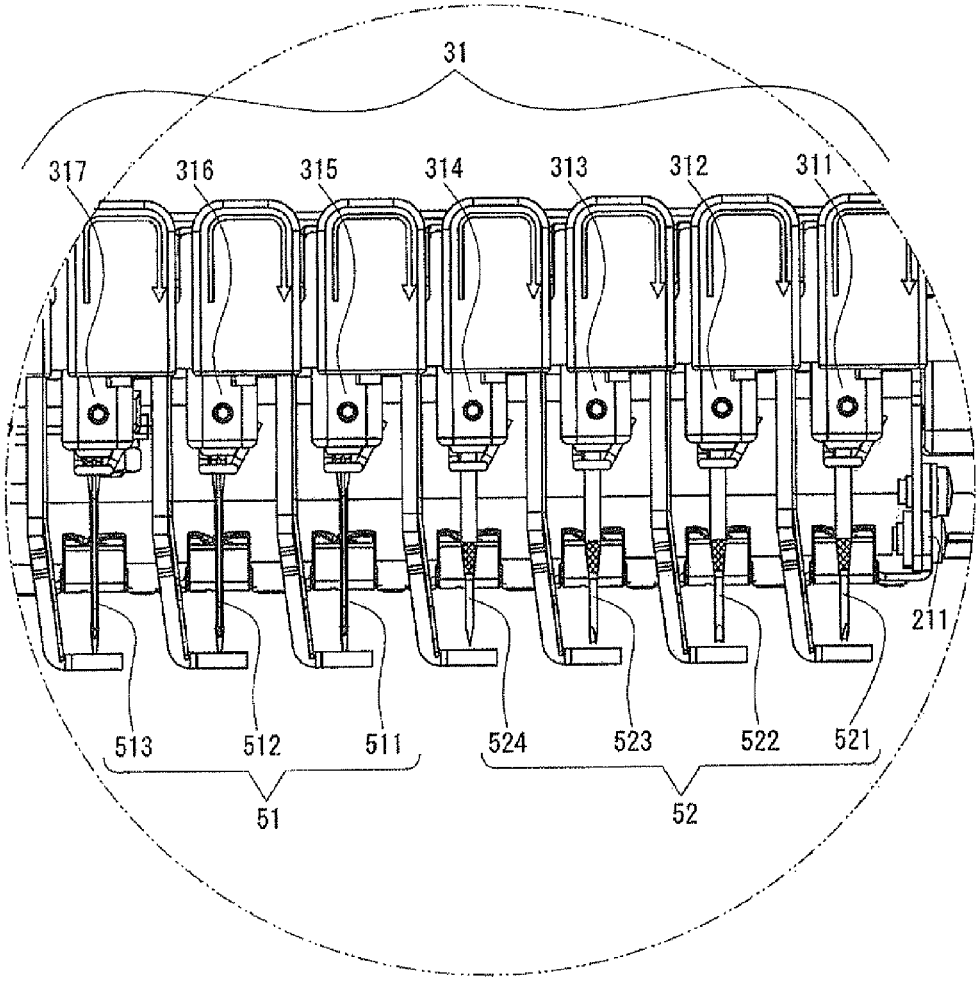
FIG. 2 is a partial front view of a lower end portion of a needle bar case.

The sewing needles 51 and the cutting needles 52 will be explained with reference to FIG. 2. Note that, of the ten needle bars 31, only the seven needle bars 31 on the right side are shown in FIG. 2. The sewing needles 51 can be attached to six of the ten needle bars 31, more specifically, the fifth to tenth needle bars 31 from the right. FIG. 2 shows a state in which the sewing needles 51 (sewing needles 511, 512 and 513) are attached to fifth to seventh needle bars 315, 316 and 317 from the right. The sewing machine 1 may slidingly move the needle bar 31, to which the sewing needle 51 is attached, in the up-down direction and thereby cause the sewing needle 51 to repeatedly reciprocate in the up-down direction. By doing this, the sewing machine 1 can perform sewing on a work cloth 39 (refer to FIG. 3).

As shown in FIG. 2, the cutting needles 52 (cutting needles 521, 522, 523 and 524) can be attached to four of the ten needle bars 31 on the right side (needle bars 311, 312, 313 and 314). Each of the cutting needles 52 has a cutting edge to form a cut in the work cloth 39 (refer to FIG. 3) on its lower end. A shaft portion provided in an upper portion of the cutting needle 52 has a partially cylindrical shape, a side surface of which is a flat surface. A positional relationship between a cutting edge direction and the flat surface formed in the shaft portion varies for each of the cutting needles 521 to 524. In a state in which the flat surface of the shaft portion of each of the cutting needles 52 faces the rear of the sewing machine 1, each of the cutting needles 52 can be attached to one of the needle bars 31. Therefore, the plurality of cutting needles 52 can be attached to the sewing machine 1 in a state in which directions of the cutting edges are different from each other. Note that, the direction of the cutting edge is a direction of the cutting edge when the cutting needle 52 forms a cut in the work cloth 39. In other words, the direction of the cutting edge means a direction of the cut to be formed in the work cloth 39.

When the cutting needle 521 is attached to the sewing machine 1, the direction of the cutting edge of the cutting needle 521 extends in a direction diagonally from the front left to the rear right. When the cutting needle 522 is attached to the sewing machine 1, the direction of the cutting edge of the cutting needle 522 extends in the left-right direction. When the cutting needle 523 is attached to the sewing machine 1, the direction of the cutting edge of the cutting needle 523 extends in a direction diagonally from the front right to the rear left. When the cutting needle 524 is attached to the sewing machine 1, the direction of the cutting edge of the cutting needle 524 extends in the front-rear direction. The sewing machine 1 may slidingly move the needle bar 31, to which the cutting needle 52 is attached, in the up-down direction and thereby cause the cutting needle 52 to repeatedly reciprocate in the up-down direction. By doing this, the sewing machine 1 can form cuts in the work cloth 39. As will be described in detail later, the sewing machine 1 can sequentially form the cuts in the work cloth 39 while switching the cutting needles 521 to 524.

An operation portion 6 shown in FIG. 1 is provided on the right side of a central portion in the front-rear direction of the arm portion 4. The operation portion 6 includes a liquid crystal display (hereinafter referred to as an LCD) 7, a touch panel 8 and a start/stop switch 41. For example, an image including various types of items, such as a command, an illustration, a setting value and a message etc., may be displayed on the LCD 7 based on image data. The touch panel 8 is provided on a front surface of the LCD 7. A user can perform a pressing operation on the touch panel 8, using a finger or a touch pen. This operation is hereinafter referred to as a panel operation. The touch panel 8 may detect a position pressed by the finger or the touch pen, and the sewing machine 1 (more specifically, a CPU 61 to be described later) may recognize the item that corresponds to the detected position. In this manner, the sewing machine 1 may recognize the selected item. The user can select a pattern, a cutting condition, a command to be executed, or the like, by performing a panel operation. The start/stop switch 41 is a switch that is used to input, to the sewing machine 1, a command to start or stop sewing or forming of cuts.

A cylinder-shaped cylinder bed 10, which extends to the front from a lower end portion of the pillar 3, is provided below the arm portion 4 shown in FIG. 1. A shuttle (not shown in the drawings) is provided inside a front end portion of the cylinder bed 10. The shuttle can house a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) may rotatably drive the shuttle. A needle plate 16, having a rectangular shape in a plan view, is provided in the upper face of the cylinder bed 10. The needle plate 16 is provided with a needle hole 36 through which the sewing needle 51 can pass.

A pair of left and right thread spool bases 12 are provided on a rear portion of an upper surface of the arm portion 4 shown in FIG. 1. The number of the thread spools 13 that can be mounted on the pair of the thread spool bases 12 is ten, which is the same as the number of the needle bars 31. A needle thread 15 may be supplied from one of the thread spools 13 mounted on the thread spool bases 12. The Needle thread 15 may be supplied, via a thread guide 17, a tensioner 18, a thread take-up lever 19 and the like, to an eye (not shown in the drawings) of each of the sewing needles 51 that are attached to the lower end of each of the needle bars 31.

A Y carriage 23 of an embroidery frame movement mechanism 11 (refer to FIG. 4) is provided below the arm portion 4. Various types of the embroidery frame 84 (refer to FIG. 3) can be attached to the embroidery frame movement mechanism 11. The embroidery frame 84 is configured to hold the work cloth 39. The embroidery frame movement mechanism 11 may cause the embroidery frame 84 to move back and forth and left and right, using an X-axis motor 132 (refer to FIG. 4) and a Y-axis motor 134 (refer to FIG. 4) as driving sources.

Figure 3:
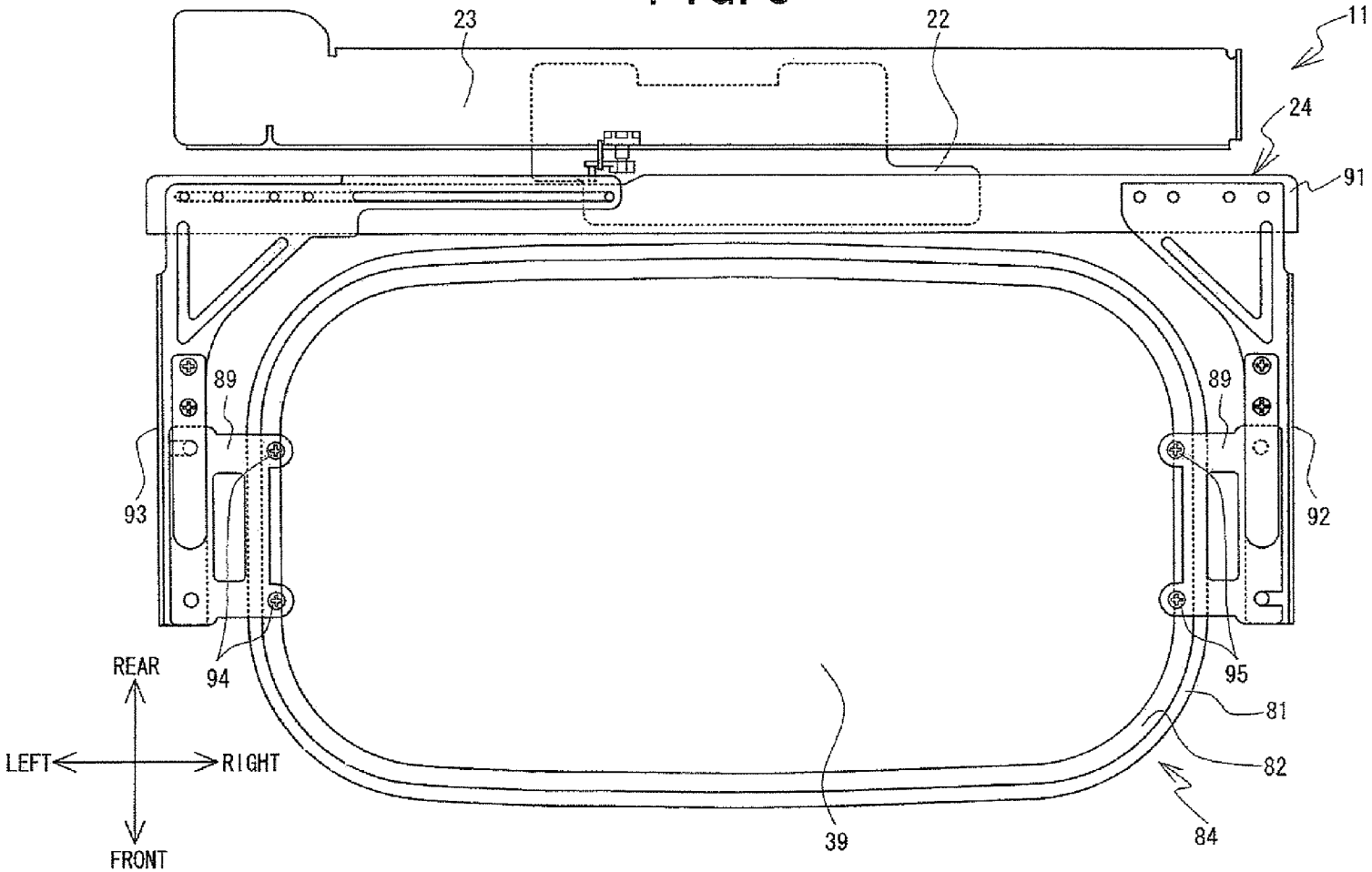
FIG. 3 is a plan view of an embroidery frame movement mechanism to which an embroidery frame is attached.

The embroidery frame 84 and the embroidery frame movement mechanism 11 will be explained with reference to FIG. 3. The embroidery frame 84 includes an outer frame 81, an inner frame 82 and a pair of left and right coupling portions 89. The outer frame 81 and the inner frame 82 of the embroidery frame 84 may clamp the work cloth 39. The coupling portions 89 are plate members having a rectangular shape in a plan view, and their central portions are cut out in a rectangular shape. One of the coupling portions 89 is fixed to a right portion of the inner frame 82 by screws 95. The other of the coupling portions 89 is fixed to a left portion of the inner frame 82 by screws 94.

The embroidery frame movement mechanism 11 includes a holder 24, an X carriage 22, an X-axis drive mechanism (not shown in the drawings), the Y carriage 23 and a Y-axis movement mechanism (not shown in the drawings). The holder 24 is configured to detachably support the embroidery frame 84. The holder 24 includes a mounting portion 91, a right arm portion 92 and a left arm portion 93. The mounting portion 91 is a plate member having a rectangular shape in a plan view, and it is longer in the left-right direction. The right arm portion 92 extends in the front-rear direction, and a rear end portion of the right arm portion 92 is fixed to the right end of the mounting portion 91. The left arm portion 93 extends in the front-rear direction. A rear end portion of the left arm portion 93 is fixed to a left portion of the mounting portion 91 such that the position in the left-right direction with respect to the mounting portion 91 can be adjusted. The right arm portion 92 may be engaged with the one of the coupling portions 89. The left arm portion 93 may be engaged with the other of the coupling portions 89.

The X carriage 22 is a plate member and is longer in the left-right direction. A part of the X carriage 22 protrudes toward the front from the front face of the Y carriage 23. The mounting portion 91 of the holder 24 may be attached to the X carriage 22. The X-axis drive mechanism (not shown in the drawings) includes a linear movement mechanism (not shown in the drawings). The linear movement mechanism includes a timing pulley (not shown in the drawings) and a timing belt (not shown in the drawings). The linear movement mechanism may cause the X carriage 22 to move in the left-right direction (in the X-axis direction), using the X-axis motor 132 as a driving source.

The Y carriage 23 is a box-shaped member that is longer in the left-right direction. The Y carriage 23 supports the X carriage 22 such that the X carriage 22 can move in the left-right direction. The Y-axis movement mechanism (not shown in the drawings) includes a pair of left and right movable members (not shown in the drawings) and a linear movement mechanism (not shown in the drawings). The movable members are connected to lower portions of the left and right ends of the Y carriage 23, and vertically pass through the guide grooves 25 (refer to FIG. 1). The linear movement mechanism includes a timing pulley (not shown in the drawings) and a timing belt (not shown in the drawings). The linear movement mechanism may cause the movable members to move in the front-rear direction (in the Y-axis direction) along the guide grooves 25, using the Y-axis motor 134 as a driving source. The Y carriage 23 that is connected to the movable members, and the X carriage 22 that is supported by the Y carriage 23 may move in the front-rear direction (in the Y-axis direction) in accordance with movement of the movable members. In a state in which the embroidery frame 84 that holds the work cloth 39 is attached to the X carriage 22, the work cloth 39 is disposed between the needle bars 31 and the needle plate 16 (refer to FIG. 1).

Figure 4:
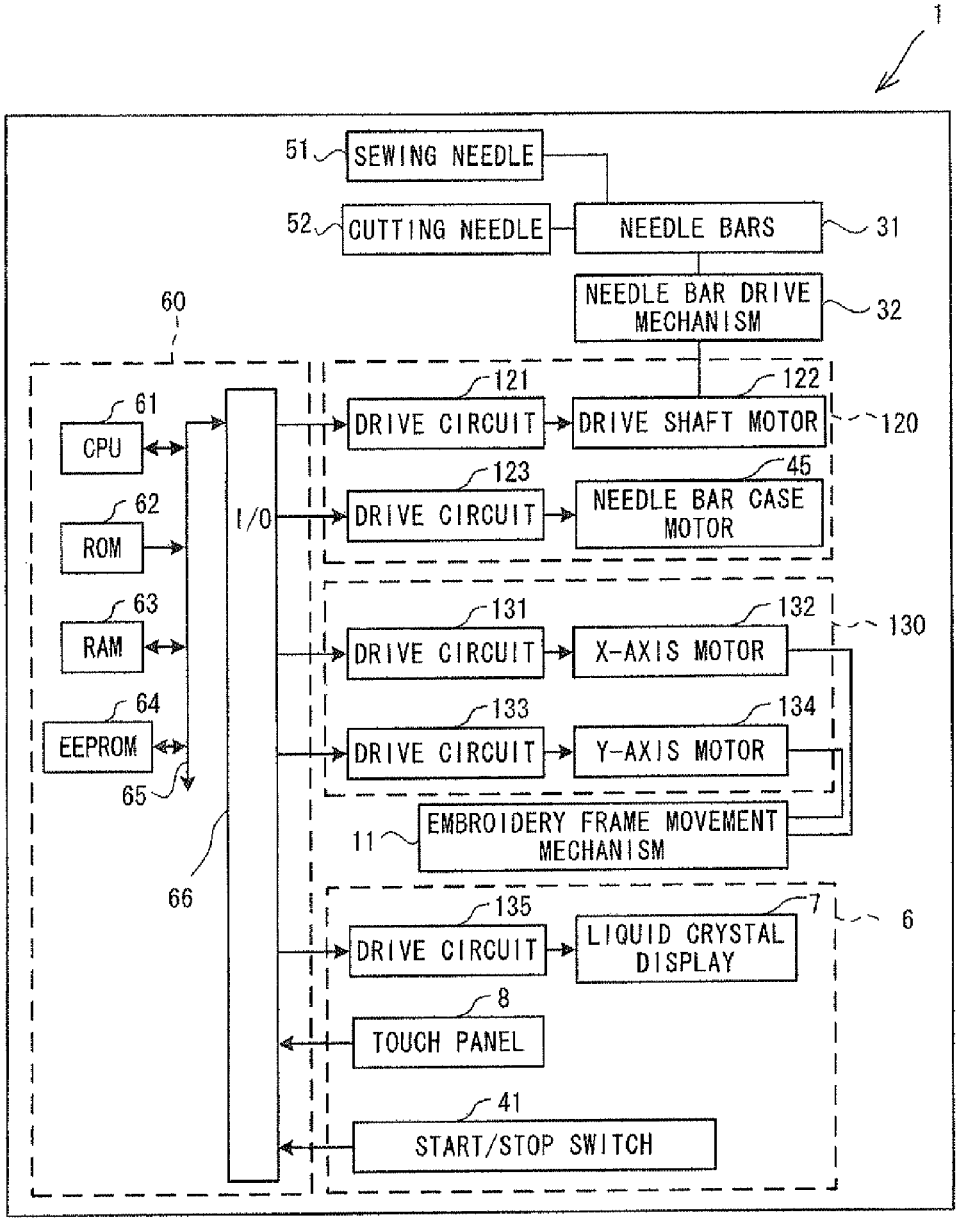
FIG. 4 is a block diagram showing an electrical configuration of the sewing machine.

An electrical configuration of the sewing machine 1 will be explained with reference to FIG. 4. As shown in FIG. 4, the sewing machine 1 includes a sewing needle drive portion 120, a sewing target drive portion 130, the operation portion 6, a control portion 60 and the image sensor 50. Hereinafter, the sewing needle drive portion 120, the sewing target drive portion 130, the operation portion 6 and the control portion 60 will be described in detail in order.

The sewing needle drive portion 120 includes a drive circuit 121, a drive shaft motor 122, a drive circuit 123 and a needle bar case motor 45. The drive circuit 121 may drive the drive shaft motor 122 in accordance with a control signal from the control portion 60. The drive shaft motor 122 may drive the needle bar drive mechanism 32 by rotatably driving a drive shaft (not shown in the drawings), and causes the needle bar 31 to reciprocate in the up-down direction. The drive circuit 123 may drive the needle bar case motor 45 in accordance with a control signal from the control portion 60. The needle bar case motor 45 may drive a movement mechanism not shown in the drawings and thereby causes the needle bar case 21 to move in the left-right direction.

The sewing target drive portion 130 includes a drive circuit 131, the X-axis motor 132, a drive circuit 133 and the Y-axis motor 134. The drive circuit 131 may drive the X-axis motor 132 in accordance with a control signal from the control portion 60. The X-axis motor 132 may drive the embroidery frame movement mechanism 11 and thereby cause the embroidery frame 84 (refer to FIG. 3) to move in the left-right direction. The drive circuit 133 may drive the Y-axis motor 134 in accordance with a control signal from the control portion 60. The Y-axis motor 134 may drive the embroidery frame movement mechanism 11 and thereby cause the embroidery frame 84 to move in the front-rear direction.

The operation portion 6 includes a drive circuit 135, the LCD 7, the touch panel 8 and the start/stop switch 41. The drive circuit 135 may drive the LCD 7 in accordance with a control signal from the control portion 60.

The control portion 60 includes the CPU 61, a ROM 62, a RAM 63, an EEPROM 64 and an input/output (I/O) interface 66, and they are mutually connected by a signal line 65. The sewing needle drive portion 120, the sewing target drive portion 130 and the operation portion 6 are respectively connected to the I/O interface 66. Hereinafter, the CPU 61, the ROM 62, the RAM 63 and the EEPROM 64 will be explained in detail.

The CPU 61 is configured to perform main control of the sewing machine 1. The CPU 61 may perform various operations and processing that relate to sewing, in accordance with various programs stored in a program storage area (not shown in the drawings) of the ROM 62. Although not shown in the drawings, the ROM 62 includes a plurality of storage areas including the program storage area. Various programs to operate the sewing machine 1, including a main program, may be stored in the program storage area. The main program is a program to perform main processing, which will be described later. The RAM 63 includes, as necessary, storage areas to store data such as operation results etc. processed by the CPU 61. Various parameters for the sewing machine 1 to perform various types of processing may be stored in the EEPROM 64.

The main processing will be explained with reference to FIG. 5. In the main processing, cut data is generated (step S11 to step S23, which will be described later). The cut data is control data that is necessary to cause the sewing machine 1 to perform operations to form cuts in the work cloth 39 along a line (hereinafter referred to as a pattern line) that indicates a shape of a pattern. The sewing machine 1 is configured to move the embroidery frame 84 based on the generated cut data. As a result, the position of the work cloth 39 with respect to the cutting needle 52 may change. The sewing machine 1 may slidingly and vertically move the needle bar 31, to the lower end of which the cutting needle 52 is attached. The sewing machine 1 may repeat the movement of the embroidery frame 84 and the vertical movement of the needle bar 31 based on the cut data, and thereby form cuts in the work cloth 39 along the pattern line (step S25, which will be described later).

Figure 5:
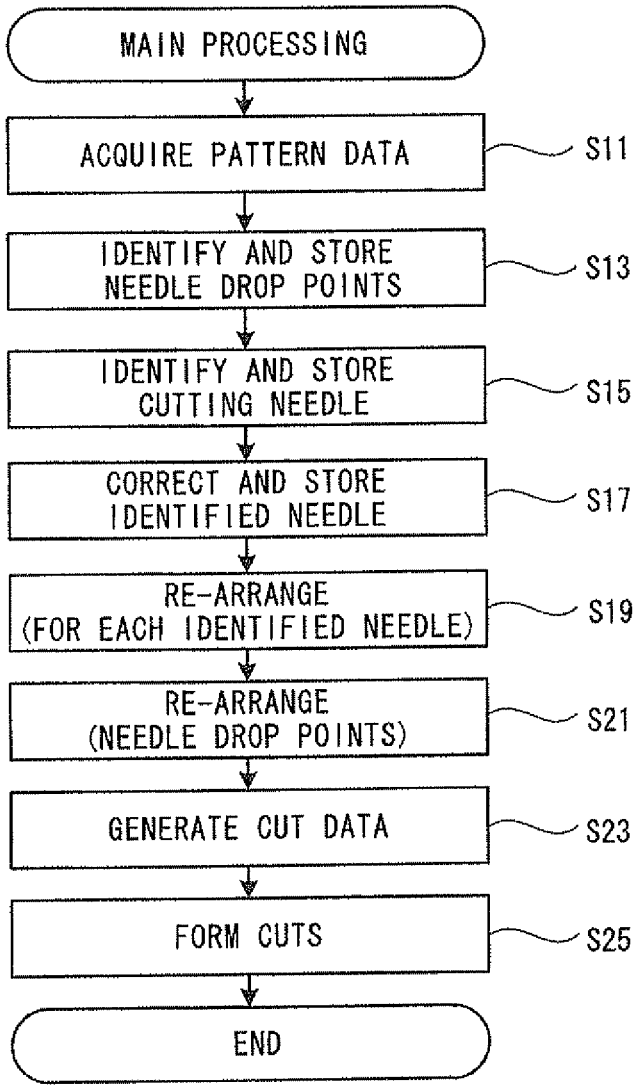
FIG. 5 is a flowchart of main processing.

The main processing shown in FIG. 5 is performed when the user inputs a command to start the main processing. The command to start the main processing may be input by a panel operation, for example. The program to perform the main processing is stored in the ROM 62 (refer to FIG. 4) and is performed by the CPU 61.

As shown in FIG. 5, in the main processing, the CPU 61 first acquires pattern data (step S11). Specifically, the pattern line is input by the user, by a panel operation. CPU 61 acquires the data indicating the input pattern line as the pattern data. The pattern data is data that can be used to identify a position of a given point on the pattern line with respect to the work cloth 39, in a case where cuts are formed along the pattern line on the work cloth 39. The pattern data may be, for example, vector data.

The CPU 61 may acquire the pattern data by another method. For example, the user may input a plurality of points as a pattern line by a panel operation. The CPU 61 may acquire data representing line segments that connect the plurality of specified points as the pattern data. Further, for example, the sewing machine 1 may be provided with a card slot not shown in the drawings. The user may insert a memory card, on which the pattern data is stored, into the card slot. The CPU 61 may acquire the pattern data by reading out the pattern data stored on the memory card inserted into the card slot.

Figure 6:
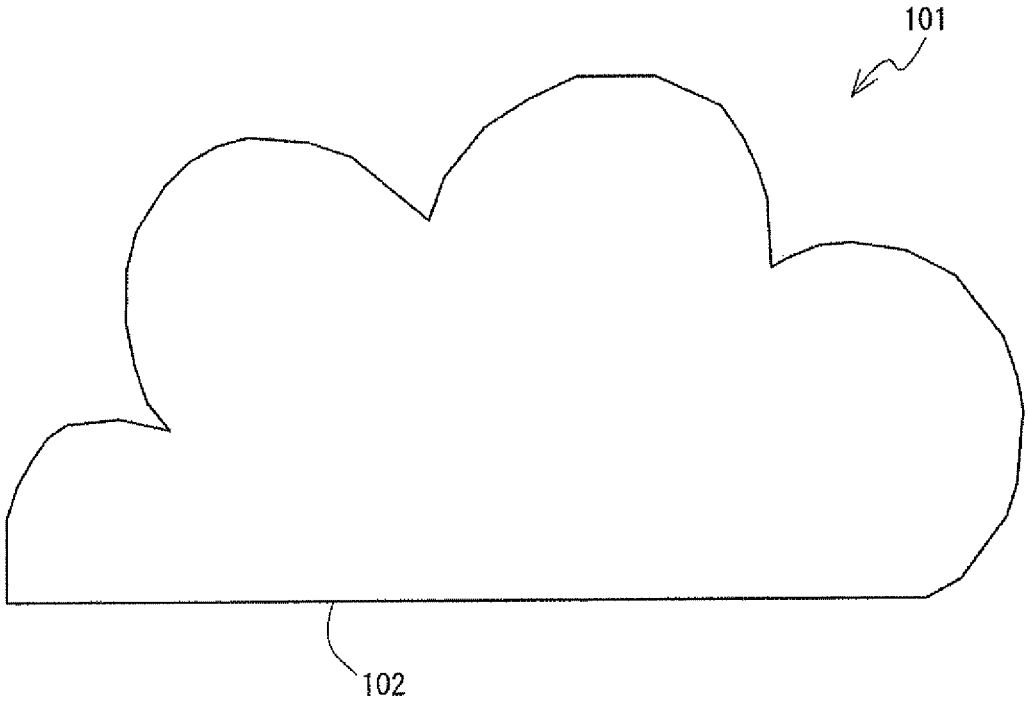
FIG. 6 is an explanatory diagram of a pattern.
Figure 7:
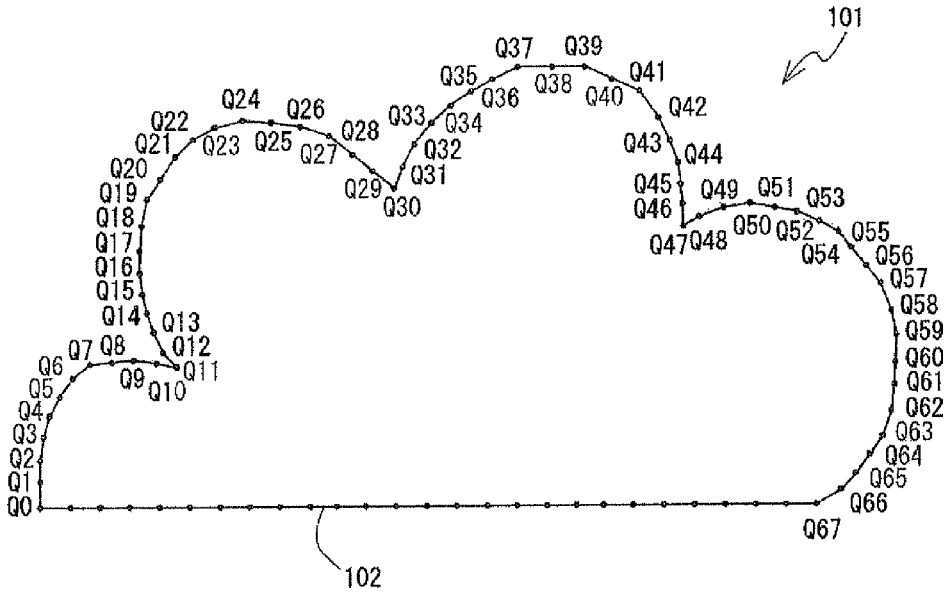
FIG. 7 is an explanatory diagram of needle drop points set on a pattern line.

The CPU 61 identifies, as needle drop points, given points on the pattern line indicated by the pattern data stored in the RAM 63 (step S13). Data that indicates positions of the identified needle drop points is stored in a table 141 (refer to FIG. 10 etc.) that is provided in the RAM 63. The table 141 will be described in detail later. For example, in a case of the pattern 101 shown in FIG. 6, the CPU 61 identifies the needle drop points such that the needle drop points are arranged at an equal interval on a pattern line 102. In this case, needle drop points QX (X=0 . . . 67 . . . ) are identified on the pattern line 102 as shown in FIG. 7. Note that the numeric values X are assigned to the identified needle drop points in order along the pattern line 102, such that the numeric value of a particular needle drop point (the point of the lower left in the FIG. 7) on the pattern line 102 is taken as 0.

The CPU 61 may identify the needle drop point using another method. For example, the CPU 61 may display a pattern line represented by the acquired pattern data on the LCD 7. The user may select and input a given point by a panel operation on the pattern line displayed on the LCD 7. The CPU 61 may identify the point input by the user as the needle drop point.

The CPU 61 identifies one of the cutting needles 521 to 524 for each of the needle drop points identified at step S13, as the cutting needle 52 that is to be inserted at each of the needle drop points (step S15). The cutting needle 52 is identified based on a direction in which the pattern line extends at a position of each of the needle drop points. Details are as follows.

An identification method of the cutting needle 52 will be specifically explained with reference to FIG. 8 and FIG. 9. First, the CPU 61 defines line segments that respectively connect two adjacent needle drop points, based on the coordinate data of the needle drop points QX (X=0 . . . 67 . . . ). In the example shown in FIG. 8, the CPU 61 defines line segments 111, 112 and 113 that respectively connect two adjacent needle drop points (Q2 and Q3, Q3 and Q4, and Q4 and Q5), based on the coordinate data of the needle drop points Q2 to Q5.

The CPU 61 identifies which of angle ranges 161, 162, 163 and 164 (refer to FIG. 9) the extending direction of each of the line segments 111, 112 and 113 is included in. FIG. 9 shows the angle ranges 161, 162, 163 and 164 that are respectively associated, in advance, with the cutting needles 521, 522, 523 and 524 (refer to FIG. 2). In FIG. 9, arrows 151, 152, 153 and 154 respectively indicate directions of the cutting edges when the cutting needles 521, 522, 523 and 524 are viewed in a plan view.

Sections located between a straight line 155 and a straight line 156 indicate the angle ranges 161. The straight line 155 is a straight line that equally divides an acute angle between the arrows 154 and 151. The straight line 156 is a straight line that equally divides an acute angle between the arrows 151 and 152. Sections located between the straight line 156 and a straight line 157 indicate the angle ranges 162. The straight line 157 is a straight line that equally divides an acute angle between the arrows 152 and 153. Sections located between the straight line 157 and a straight line 158 indicate the angle ranges 163. The straight line 158 is a straight line that equally divides an acute angle between the arrows 153 and 154. Sections located between the straight line 158 and the straight line 155 indicate the angle ranges 164.

The angle ranges 161 indicate a range from 22.5° to 67.5° and a range from 202.5° to 247.5°. The angle ranges 162 indicate a range from 337.5° to 22.5° and a range from 157.5° to 202.5°. The angle ranges 163 indicate a range from 112.5° to 157.5° and a range from 292.5° to 337.5°. The angle ranges 164 indicate a range from 67.5° to 112.5° and a range from 247.5° to 292.5°. The angle ranges 161, 162, 163 and 164 are respectively associated with the cutting needles 521, 522, 523 and 524.

Figure 8:
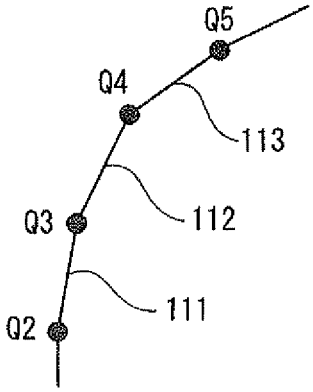
FIG. 8 is an explanatory diagram of an identification method of a cutting needle.
Figure 9:
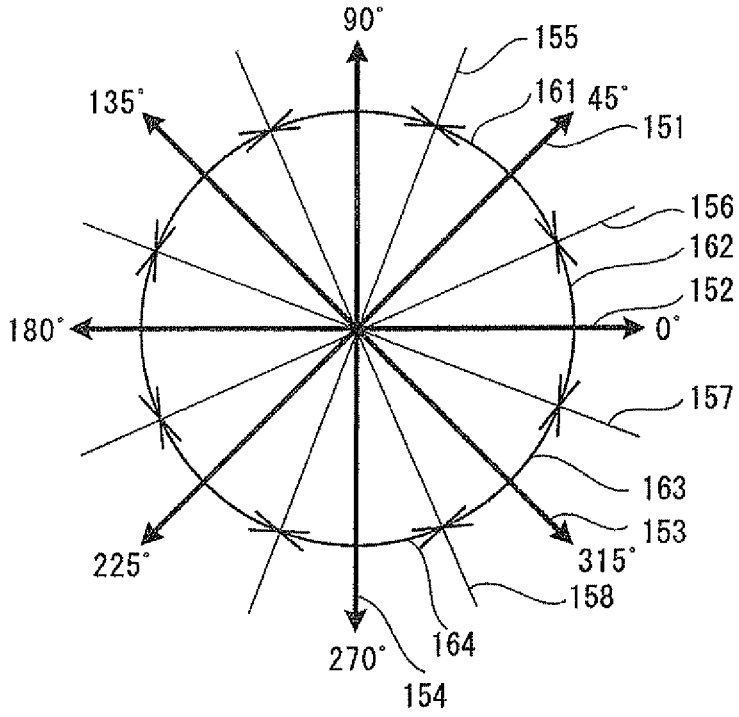
FIG. 9 is an explanatory diagram of angle ranges.

For example, the extending directions of the line segments 111 and 112 shown in FIG. 8 are included in the angle ranges 164, among the angle ranges 161, 162, 163 and 164 shown in FIG. 9. In this case, at step S15, the CPU 61 identifies the cutting needle 524 that corresponds to the angle ranges 164, as the cutting needle 52 that is to be inserted at each of the needle drop points Q2 and Q3 positioned at both ends of the line segment 111. In a similar manner, the CPU 61 identifies the cutting needle 524 that corresponds to the angle ranges 164, as the cutting needle 52 that is to be inserted at each of the needle drop points Q3 and Q4 positioned at both ends of the line segment 112. The direction in which the line segment 113 extends is included in the angle ranges 161. Therefore, the CPU 61 identifies the cutting needle 521 that corresponds to the angle ranges 161, as the cutting needle 52 that is to be inserted at each of the needle drop points Q4 and Q5 positioned at both ends of the line segment 113. Hereinafter, the cutting needle 52 that is identified for each of the needle drop points is also referred to as an identified needle.

The direction of the cutting edge of the cutting needle 52 identified for each of the needle drop points as described above may favorably approximate the direction of the tangent line of the pattern line at each of the needle drop points. Therefore, when the sewing machine 1 forms cuts by piercing the identified cutting needle 52 into the work cloth 39, cuts having a good appearance can be formed along the pattern line. Further, the CPU 61 identifies the cutting needle 52 based on the direction in which the line segment that connects adjacent two needle drop points extends. Therefore, complicated processing to calculate the actual tangent line of the pattern line at each of the needle drop points is not required. Thus, the CPU 61 can easily and accurately identify the cutting needle 52 that is to be inserted at each of the needle drop points.

Both of the cutting needles 52 that are respectively identified based on the line segment 111 and the line segment 112 are the cutting needle 524. Therefore, the only cutting needle 524 is identified as the cutting needle 52 that corresponds to the needle drop point Q3. On the other hand, the cutting needle 52 that is identified based on the line segment 112 is the cutting needle 524. The cutting needle 52 that is identified based on the line segment 113 is the cutting needle 521. Therefore, the two cutting needles 521 and 524 are identified as the cutting needle 52 that is to be inserted at the needle drop point Q4. Thus, the cutting needle 521 and the cutting needle 524 are to be respectively inserted at the needle drop point Q4.

Data indicating the identified needle (hereinafter referred to as identified needle data) that is identified for each of the needle drop points as described above is associated with the coordinate data indicating the position of each of the needle drop points, and is stored in the table 141 (refer to FIG. 10) (step S15, refer to FIG. 5). In the table 141 shown in FIG. 10, the needle drop points QX (X=0, 1 . . . ) indicate the coordinate data of the respective needle drop points. The numbers 1, 2, 3 and 4 that are associated with the respective needle drop points QX, as the identified needles, respectively indicate the identified needle data indicating the cutting needles 521, 522, 523 and 524. Hereinafter, the coordinate data of the needle drop points QX stored in the table 141 are also simply referred to as the needle drop points QX. The identified needle data 1, 2, 3 and 4 are also simply referred to as the identified needles 1, 2, 3 and 4.

As shown in FIG. 5, after the cutting needle is identified, as the identified needle, for each of the needle drop points at step S15, the CPU 61 corrects the identified needle data stored in the table 141 (refer to FIG. 10 etc.) in the following manner (step S17). A specific explanation will be given with reference to the table 141 shown in FIG. 10. The CPU 61 refers to the identified needle data stored in the table 141, sequentially from the needle drop point Q1. The CPU 61 calculates a continuous number of times that is the number of times that the same identified needle data is continuous. For example, in FIG. 10, since the identified needle 4 (the cutting needle 524) is associated with each of the needle drop points Q0 to Q4, 5 is calculated as the continuous number of times. In a similar manner, since the identified needle 1 (the cutting needle 521) is associated with each of the needle drop points Q4 to Q7, 4 is calculated as the continuous number of times. For each of the needle drop points Q7 to Q11 (the identified needle 2 (the cutting needle 522)), 5 is calculated as the continuous number of times. For each of the needle drop points Q11 and Q12 (the identified needle 3 (the cutting needle 523)), 2 is calculated as the continuous number of times. For each of the needle drop points Q12 to Q19 (the identified needle 4 (the cutting needle 524)), 8 is calculated as the continuous number of times. Similar calculation processing is performed for all the needle drop points QX.

The CPU 61 compares the calculated continuous number of times with a predetermined threshold value. In the present embodiment, for example, the threshold value is 4. The CPU 61 extracts the needle drop points QX for which the calculated continuous number of times is less than 4. In the example of FIG. 10, the needle drop points Q1 to Q12 (for which the continuous number of times is 2), the needle drop points Q37 to Q39 (for which the continuous number of times is 3), and the needle drop points Q47 and Q48 (for which the continuous number of times is 2) are extracted. In a case where the cut data is generated based on the table 141 shown in FIG. 10, processing is performed in which the cutting needle 52 is inserted at the needle drop points QX sequentially from the needle drop point Q0. In this case, in sections containing the above-described extracted needle drop points, the sewing machine 1 needs to switch the cutting needle 52 frequently in a short period. In order to switch the cutting needle 52, the sewing machine 1 needs to stop rotation of the drive shaft motor 122 every time the cutting needle 52 is switched, and to move the needle bar case 21 in the left-right direction. Therefore, extra time is required in comparison to a case in which the same cutting needle 52 is continuously used. For that reason, it takes time for the sewing machine 1 to complete the forming of all the cuts in the work cloth 39 along the pattern line.

To address this, the CPU 61 replaces the identified needle data of the extracted needle drop point QX with the identified needle data that corresponds to a needle drop point Q (X+1) that is a needle drop point immediately after the extracted needle drop point QX. For example, in the case of the needle drop points Q11 and Q12 in the table 141, the continuous number of times of the corresponding identified needle 3 (the cutting needle 523) is small (2). Therefore, the identified needle 3 (the cutting needle 523) corresponding to the needle drop points Q11 and Q12 is replaced with the identified needle 4 (the cutting needle 524) that corresponds to the needle drop point Q13. In a similar manner, the identified needle 2 (the cutting needle 522) corresponding to the needle drop points Q37 to Q39 is replaced with the identified needle 3 (the cutting needle 523) that corresponds to the needle drop point Q40. The identified needle 1 (the cutting needle 521) corresponding to the needle drop points Q47 and Q48 is replaced with the identified needle 2 (the cutting needle 522) that corresponds to the needle drop point Q49.

Since the above correction is performed, the identified needle data of the table 141 shown in FIG. 10 is corrected as shown in FIG. 11. In the table 141 shown in FIG. 11, the continuous number of times of the identified needle data corresponding to the needle drop points Q11 and Q12, Q37 to Q39, and Q47 and Q48 is increased by replacing the identified needle data as described above. Therefore, in a case where the cut data is generated based on the table 141 shown in FIG. 11, and the sewing machine 1 operates based on the cut data, frequent switching of the cutting needle 52 can be inhibited. As a result, the sewing machine 1 can shorten the time required until the sewing machine 1 completes the forming of all the cuts in the work cloth 39 along the pattern line.

Note that, at step S17, the CPU 61 may replace the identified needle data for which the continuous number of times is small, not by the identified needle data corresponding to the needle drop point Q (X+1) immediately after the extracted needle drop point QX, but by the identified needle data corresponding to an immediately preceding needle drop point Q (X−1).

As shown in FIG. 5, after the identified needle data for which the continuous number of times is small is corrected at step S17, the CPU 61 re-arranges the data (more specifically, the coordinate data and the corresponding identified needle data) stored in the table 141, for each identified needle data, so that the same cutting needle 52 is continuously used as much as possible when the sewing machine 1 is operated (step S19). Hereinafter, a specific explanation will be given with reference to FIG. 11 and FIG. 12.

First, among the data stored in the table 141, the CPU 61 groups the identified needle 1 (the cutting needle 521) and the plurality of needle drop points QX associated with the identified needle 1. As shown in FIG. 11, before the re-arrangement, the identified needle 1 (the cutting needle 521) is associated with the needle drop points Q4 to Q7, Q19 to Q23, Q30 to Q37 and Q63 to Q67. Therefore, the data of these needle drop points is grouped as a first group. The data of the first group is arranged in ascending order of the X values of the needle drop points QX. Next, the CPU 61 groups the needle drop points QX associated with the identified needle 2 (the cutting needle 522). As shown in FIG. 11, before the re-arrangement, the identified needle 2 (the cutting needle 522) is associated with the needle drop points Q7 to Q11, Q23 to Q27, Q47 to Q52 and Q67 to Q70. Therefore, the data of these needle drop points is grouped as a second group. The data of the second group is arranged in ascending order of the X values of the needle drop points QX. Similar processing is also performed for the coordinate data of the needle drop points corresponding to the identified needle 3 (the cutting needle 523) and the identified needle 4 (the cutting needle 524), and the data is grouped as a third group and a fourth group, respectively.

As shown in FIG. 12, the data grouped for each of the identified needles is stored in the table 141 in an order of the first group, the second group, the third group and the fourth group. In a case where the cut data is generated based on the table 141 shown in FIG. 12 and the sewing machine 1 operates based on the cut data, the number of times the cutting needle 52 is switched can be further reduced. Thus the sewing machine 1 can further shorten the time for the sewing machine 1 to complete the forming of all the cuts in the work cloth 39 along the pattern line.

As shown in FIG. 5, after the data are re-arranged at step S19, the CPU 61 further re-arranges the data stored in the table 141 so that a change in the positions of the needle drop points is reduced as much as possible when the sewing machine 1 switches the cutting needle 52 (step S21). Hereinafter, a specific explanation will be given with reference to FIG. 12 and FIG. 13.

In a case where the cut data is generated based on the table 141 shown in FIG. 12 and the sewing machine 1 operates based on the cut data, after the cutting needle 521 is inserted at the needle drop point Q67 of the first group, the cutting needle 52 is switched from the cutting needle 521 to the cutting needle 522. In the table 141, the needle drop point Q7 of the second group is arranged following the needle drop point Q67 of the first group. Therefore, the sewing machine 1 moves the embroidery frame 84 that holds the work cloth 39 so that the cutting needle 522 can be inserted at the needle drop point Q7. Since the needle drop point Q67 and the needle drop point Q7 are located at positions relatively separated from each other on the pattern line 102 (refer to FIG. 7), the movement amount of the embroidery frame 84 is relatively large. As the movement amount of the embroidery frame 84 becomes larger, the time for the movement of the embroidery frame 84 to be complete becomes longer. Therefore, the time for the sewing machine 1 to complete the forming of all the cuts in the work cloth 39 along the pattern line is increased by the time required for the movement of the embroidery frame 84.

To address this, the CPU 61 reduces the movement amount of the embroidery frame 84 as much as possible by re-arranging the data of the table 141 in the following manner, and shortens the time required for the movement of the embroidery frame 84 to be complete. The CPU 61 re-arranges the data of each of the groups such that, next to the last needle drop point of the previous group, there is the needle drop point which is one of the needle drop points of the next group and which is closest to the last needle drop point of the previous group. More specifically, the CPU 61 re-arranges the data of the second group corresponding to the identified needle 2 (the cutting needle 522) so that the needle drop point QX that is closest to the needle drop point Q67 is selected as the needle drop point QX subsequent to the last needle drop point Q67 of the first group. As shown in FIG. 12, in addition to the identified needle 1 (the cutting needle 521), the identified needle 2 (the cutting needle 522) is also associated with the needle drop point Q67. Therefore, as shown in FIG. 13, the CPU 61 arranges the needle drop point Q67 and the identified needle data corresponding to the needle drop point Q67, at the head of the second group. Next, the CPU 61 arranges the other data in the order of the X values of the needle drop points QX. When the data of the second group corresponding to the cutting needle 522 are re-arranged in this manner, the needle drop point Q52 is located at the end of the second group. Accordingly, the needle drop point QX that is last to be inserted by the cutting needle 522 is the needle drop point Q52.

Next, the CPU 61 re-arranges the data of the third group corresponding to the identified needle 3 (the cutting needle 523) so that the needle drop point QX that is closest to the needle drop point Q52 is selected, from among the needle drop points QX of the third group that correspond to the identified needle 3 (the cutting needle 523), as the needle drop point that at which the cutting needle 523 is to be inserted subsequent to the needle drop point Q52. As shown in FIG. 12, in addition to the identified needle 2 (the cutting needle 522), the identified needle 3 (the cutting needle 523) is also associated with the needle drop point Q52. Therefore, as shown in FIG. 13, the CPU 61 arranges the needle drop point Q52 and the identified needle data corresponding to the needle drop point Q52, at the head of the third group. Next, the CPU 61 arranges the other data in the order of the X values of the needle drop points QX. Similar processing is also performed for the data of the fourth group corresponding to the cutting needle 524. The re-arranged data are stored in the table 141 (refer to FIG. 13) in the order of the identified needles 1, 2, 3 and 4, namely, in the order of the first group, the second group, the third group and the fourth group. Thus, in a case where the cut data is generated based on the table 141 and the sewing machine 1 operates based on the cut data, it is possible to reduce the movement amount of the embroidery frame 84 as much as possible when the cutting needle 52 is switched. As a result, the time required for the movement of the embroidery frame 84 to be complete can be shortened. Thus the sewing machine 1 can shorten the time for the sewing machine 1 to complete the forming of all the cuts in the work cloth 39 along the pattern line.

As shown in FIG. 5, after the above-described re-arrangement processing is performed at step S21, the CPU 61 generates the cut data that is necessary to insert the cutting needle 52 that is identified by the identified needle stored in the table 141 at the corresponding needle drop points QX in order (step S23). The CPU 61 drives the sewing needle drive portion 120 and the sewing target drive portion 130 based on the generated cut data, and thereby sequentially inserts the cutting needle 52 into the work cloth 39 held by the embroidery frame 84. By doing this, the sewing machine 1 forms the cuts in the work cloth 39 along the pattern line (step S25). The main processing ends.

Figure 14:
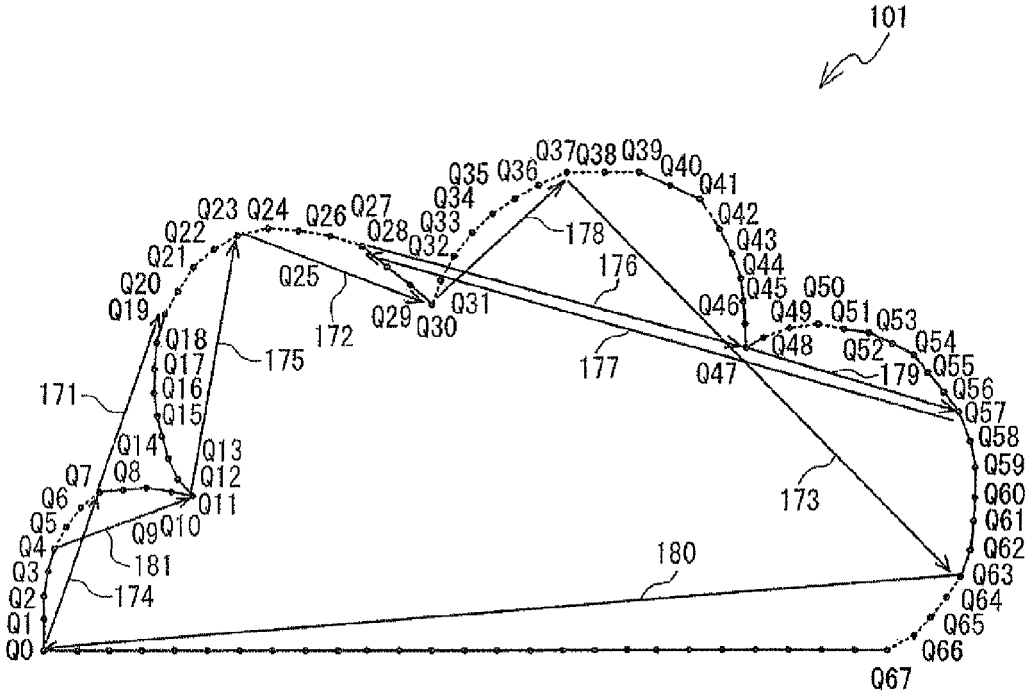
FIG. 14 is an explanatory diagram of an order when cuts are formed along the pattern line.

FIG. 14 shows a manner in which the needle drop points are changed in a case where cuts are formed in the work cloth 39 along the pattern line 102 based on the cut data generated based on the table 141. First, the cutting needle 521 is sequentially inserted at the needle drop points Q4 to Q7. The needle drop point moves from Q7 to Q19 (an arrow 171). The cutting needle 521 is sequentially inserted at the needle drop points Q19 to Q23. The needle drop point moves from Q23 to Q30 (an arrow 172). The cutting needle 521 is sequentially inserted at the needle drop points Q30 to Q37. The needle drop point moves from Q37 to Q63 (an arrow 173). The cutting needle 521 is sequentially inserted at the needle drop points Q63 to Q67.

The cutting needle 521 is switched to the cutting needle 522. The cutting needle 522 is sequentially inserted at the needle drop points Q67 to Q0. The needle drop point moves from Q0 to Q7 (an arrow 174). The cutting needle 522 is sequentially inserted at the needle drop points Q7 to Q11. The needle drop point moves from Q11 to Q23 (an arrow 175). The cutting needle 522 is sequentially inserted at the needle drop points Q23 to Q27. The needle drop point moves from Q27 to Q47 (an arrow 176). The cutting needle 522 is sequentially inserted at the needle drop points Q47 to Q52.

The cutting needle 522 is switched to the cutting needle 523. The cutting needle 523 is sequentially inserted at the needle drop points Q52 to Q57. The needle drop point moves from Q57 to Q27 (an arrow 177). The cutting needle 523 is sequentially inserted at the needle drop points Q27 to Q30. The needle drop point moves from Q30 to Q37 (an arrow 178). The cutting needle 523 is sequentially inserted at the needle drop points Q37 to Q42.

The cutting needle 523 is switched to the cutting needle 524. The cutting needle 524 is sequentially inserted at the needle drop points Q42 to Q47. The needle drop point moves from Q47 to Q57 (an arrow 179). The cutting needle 524 is sequentially inserted at the needle drop points Q57 to Q63. The needle drop point moves from Q63 to Q0 (an arrow 180). The cutting needle 524 is sequentially inserted at the needle drop points Q0 to Q4. The needle drop point moves from Q4 to Q11 (an arrow 181). The cutting needle 524 is sequentially inserted at the needle drop points Q11 to Q19.

As described above, in a case where the cuts are formed in the work cloth 39 based on the generated cut data, the number of times of the switching of the cutting needle 52 can be reduced to three times. Therefore, the time required to switch the cutting needle 52 can be shortened. Further, since the number of times the needle drop point moves to a position other than an adjacent needle drop point is reduced to eleven times, the movement amount of the embroidery frame 84 can be reduced. Accordingly, the movement amount of the embroidery frame 84 when one of the cutting needles 52 is switched to another of the cutting needles 52 can be reduced to a minimum. Thus, the time required to complete the movement of the embroidery frame 84 can be shortened.

As explained above, in a case where the number of times the same cutting needle 52 is continuously inserted into the work cloth 39 is small, the sewing machine 1 replaces the corresponding cutting needle 52. By doing this, the sewing machine 1 can inhibit frequent switching of the cutting needle 52 that is to be inserted into the work cloth 39. As a result, the sewing machine 1 can shorten the time required to switch the cutting needle 52. Thus, the sewing machine 1 can form the cuts in the work cloth 39 in a short time, along the line that indicates the shape of the pattern desired by the user.

Note that the above-described embodiment can be modified in various ways. For example, the cut data may be generated not by the sewing machine 1 but by an external device. For example, a known personal computer may be used as the external device. For example, the cut data generated by a CPU of the personal computer as the external device may be stored on a memory card. The sewing machine 1 may be provided with a card slot not shown in the drawings, and when the memory card is inserted into the card slot, the sewing machine 1 may read and acquire the cut data stored on the memory card. The sewing machine 1 may form the cuts in the work cloth 39 by driving the sewing needle drive portion 120 and the sewing target drive portion 130 based on the acquired cut data.

The number of the cutting needles 52 that can be attached to the sewing machine 1 is not limited to four as in the above-described embodiment, and it may be a number other than four. At step S15 of the main processing shown in FIG. 5, the cutting needle may be identified by another method. For example, the CPU 61 may calculate a tangent line of the pattern line at the needle drop point QX, and may identify the cutting needle 52 based on an angle of the calculated tangent line. The predetermined threshold value used at step S17 of the main processing may be smaller than four, or may be larger than four. As the threshold value is reduced, cuts with an improved appearance can be formed, though it takes more time to form the cuts. As the threshold value is increased, the cuts can be formed in a shorter time, although the appearance of the cuts may be less attractive.

At step S19 of the main processing, the CPU 61 re-arranges the data stored in the table 141 by grouping the needle drop points QX corresponding to the same identified needle data. However, the CPU 61 need not necessarily re-arrange the data at step S19. In this case, the needle drop point QX moves in an order of Q0, Q1, . . . . It is therefore possible to reduce the movement amount of the embroidery frame 84 to the minimum. By doing this, the time required for the movement of the embroidery frame 84 can be shortened, and the sewing machine 1 can shorten the time required until the sewing machine 1 completes the forming of all the cuts along the pattern line. Further, at step S21, the CPU 61 re-arranges the data stored in the table 141 so that the change in the positions of the needle drop points QX is reduced. However, the CPU 61 need not necessarily re-arrange the data at step S21.

Index data indicating the order in which the CPU 61 reads out the data stored in the table 141 may be associated with the needle drop points QX. In this case, instead of re-arranging the data stored in the table 141, the CPU 61 may change the order of the needle drop points QX by correcting the associated index data.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions that instruct the apparatus to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying, as a corresponding identified needle, one of a plurality of cutting needles configured to be attachable to a plurality of needle bars of a multi-needle sewing machine in a state in which directions of cutting edges of the plurality of cutting needles are different from each other, the identifying being performed for each of the plurality of cutting needle drop points;

storing cutting needle drop point data and identified needle data in association with each other in the memory, the cutting needle drop point data being data indicating each of the plurality of cutting needle drop points, and the identified needle data being data indicating the identified needle identified for each of the plurality of cutting needle drop points;

identifying, based on the cutting needle drop point data and the identified needle data stored in the memory, a continuous number of times, which is the number of times that the identified needle is continuously the same in an adjacent order on the pattern line;

replacing, among the identified needle data stored in the memory, the identified needle data of the identified needle for which the identified continuous number of times is smaller than a threshold value, with other identified needle data corresponding to the cutting needle drop point data of one of a previous cutting needle drop point and a subsequent cutting needle drop point in the order; and generating cut data based on the cutting needle drop point data and the identified needle data stored in the memory, the cut data being data for the multi-needle sewing machine to sequentially insert the corresponding identified needle at the plurality of cutting needle drop points along the pattern line.

2. The apparatus according to claim 1, wherein the generating the cut data includes:

identifying at least one group, each of the at least one group including the cutting needle drop point data associated with the same identified needle data, among the cutting needle drop point data and the identified needle data stored in the memory, and generating, for each of the identified at least one group, data to sequentially insert the same identified needle indicated by the same identified needle data at at least one cutting needle drop point indicated by the cutting needle drop point data belonging to the group.

3. The apparatus according to claim 2, wherein in a case where a plurality of the groups are identified, the generating the cut data includes generating the data for each of the plurality of groups in which, among the cutting needle drop point data belonging to a next group, the cutting needle drop point data indicating a cutting needle drop point that is closest to a cutting needle drop point indicated by the last cutting needle drop point data in the previous group is taken as the first cutting needle drop point data in the next group.

4. The apparatus according to claim 1, wherein the identifying the identified needle for each of the plurality of cutting needle drop points includes identifying the identified needle based on an extending direction of a line segment that connects each of the plurality of cutting needle drop points with another adjacent cutting needle drop point, and on the direction of the cutting edge.

5. A non-transitory computer-readable medium storing computer-readable instructions that instruct an apparatus to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying, as a corresponding identified needle, one of a plurality of cutting needles configured to be attachable to a plurality of needle bars of a multi-needle sewing machine in a state in which directions of cutting edges of the plurality of cutting needles are different from each other, the identifying being performed for each of the plurality of cutting needle drop points;

storing cutting needle drop point data and identified needle data in association with each other in a memory, the cutting needle drop point data being data indicating each of the plurality of cutting needle drop points, and the identified needle data being data indicating the identified needle identified for each of the plurality of cutting needle drop points;

identifying, based on the cutting needle drop point data and the identified needle data stored in the memory, a continuous number of times, which is the number of times that the identified needle is continuously the same in an adjacent order on the pattern line;

replacing, among the identified needle data stored in the memory, the identified needle data of the identified needle for which the identified continuous number of times is smaller than a threshold value, with other identified needle data corresponding to the cutting needle drop point data of one of a previous cutting needle drop point and a subsequent cutting needle drop point in the order; and generating cut data based on the cutting needle drop point data and the identified needle data stored in the memory, the cut data being data for the multi-needle sewing machine to sequentially insert the corresponding identified needle at the plurality of cutting needle drop points along the pattern line.

6. The non-transitory computer-readable medium according to claim 5, wherein the generating the cut data includes:

identifying at least one group, each of the at least one group including the cutting needle drop point data associated with the same identified needle data, among the cutting needle drop point data and the identified needle data stored in the memory, and generating, for each of the identified at least one group, data to sequentially insert the same identified needle indicated by the same identified needle data at at least one cutting needle drop point indicated by the cutting needle drop point data belonging to the group.

7. The non-transitory computer-readable medium according to claim 6, wherein in a case where a plurality of the groups are identified, the generating the cut data includes generating the data for each of the plurality of groups in which, among the cutting needle drop point data belonging to a next group, the cutting needle drop point data indicating a cutting needle drop point that is closest to a cutting needle drop point indicated by the last cutting needle drop point data in the previous group is taken as the first cutting needle drop point data in the next group.

8. The non-transitory computer-readable medium according to claim 5, wherein the identifying the identified needle for each of the plurality of cutting needle drop points includes identifying the identified needle based on an extending direction of a line segment that connects each of the plurality of cutting needle drop points with another adjacent cutting needle drop point, and on the direction of the cutting edge.

9. A sewing machine comprising:

a plurality of needle bars to which a plurality of cutting needles are configured to be attachable in a state in which directions of cutting edges of the plurality of cutting needles are different from each other;

a processor; and a memory configured to store computer-readable instructions that instruct the sewing machine to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying one of the plurality of cutting needles as a corresponding identified needle, the identifying being performed for each of the plurality of cutting needle drop points;

storing cutting needle drop point data and identified needle data in association with each other in the memory, the cutting needle drop point data being data indicating each of the plurality of cutting needle drop points, and the identified needle data being data indicating the identified needle identified for each of the plurality of cutting needle drop points;

identifying, based on the cutting needle drop point data and the identified needle data stored in the memory, a continuous number of times, which is the number of times that the identified needle is continuously the same in an adjacent order on the pattern line;

replacing, among the identified needle data stored in the memory, the identified needle data of the identified needle for which the identified continuous number of times is smaller than a threshold value, with other identified needle data corresponding to the cutting needle drop point data of one of a previous cutting needle drop point and a subsequent cutting needle drop point in the order;

generating cut data based on the cutting needle drop point data and the identified needle data stored in the memory, the cut data being data for the sewing machine to sequentially insert the corresponding identified needle at the plurality of cutting needle drop points along the pattern line; and generating a signal based on the cut data, the sewing machine being configured to form the cuts in the work cloth based on the signal.

10. The sewing machine according to claim 9, wherein the generating the cut data includes:

identifying at least one group, each of the at least one group including the cutting needle drop point data associated with the same identified needle data, among the cutting needle drop point data and the identified needle data stored in the memory, and generating, for each of the identified at least one group, data to sequentially insert the same identified needle indicated by the same identified needle data at at least one cutting needle drop point indicated by the cutting needle drop point data belonging to the group.

11. The sewing machine according to claim 10, wherein in a case where a plurality of the groups are identified, the generating the cut data includes generating the data for each of the plurality of groups in which, among the cutting needle drop point data belonging to a next group, the cutting needle drop point data indicating a cutting needle drop point that is closest to a cutting needle drop point indicated by the last cutting needle drop point data in the previous group is taken as the first cutting needle drop point data in the next group.

12. The sewing machine according to claim 9, wherein the identifying the identified needle for each of the plurality of cutting needle drop points includes identifying the identified needle based on an extending direction of a line segment that connects each of the plurality of cutting needle drop points with another adjacent cutting needle drop point, and on the direction of the cutting edge.

* * * * *